US009842713B2

(12) United States Patent
Yu et al.

(10) Patent No.: US 9,842,713 B2
(45) Date of Patent: Dec. 12, 2017

(54) VACUUM CIRCUIT INTERRUPTER

(71) Applicant: Eaton Corporation, Cleveland, OH (US)

(72) Inventors: Li Yu, Pittsburgh, PA (US); Martin Bernardus Johannes Leusenkamp, Suzhou (CN); He Yang, Shanghai (CN); Wenjie Hou, Shanghai (CN); Yucheng Li, Suzhou (CN); Jun Yan, Suzhou (CN)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 15/084,871

(22) Filed: Mar. 30, 2016

(65) Prior Publication Data

US 2017/0287660 A1 Oct. 5, 2017

(51) Int. Cl.
*H01H 33/666* (2006.01)
*H01H 33/88* (2006.01)

(52) U.S. Cl.
CPC ..... *H01H 33/666* (2013.01); *H01H 33/88* (2013.01)

(58) Field of Classification Search
CPC ..... H01H 33/664; H01H 33/666; H01H 33/66261; H01H 33/6644; H01H 33/6646; H01H 33/6641; H01H 33/6643; H01H 2009/523; H01H 33/66207; H01H 1/66; H01H 33/32; H01H 33/66; H01H 33/6606; H01H 33/6623
See application file for complete search history.

(56) References Cited

U.S. PATENT DOCUMENTS 3,889,079 A * 6/1975 Emmerich ..... H01H 33/664 218/136
4,081,640 A * 3/1978 Rich ..... H01H 33/664 218/123
4,553,002 A * 11/1985 Slade ..... H01H 33/664 218/128
4,557,529 A 12/1985 Cherry et al.
4,630,361 A * 12/1986 Inagaki ..... H01H 11/00 218/134

(Continued)

FOREIGN PATENT DOCUMENTS

CN 103871775 6/2014
EP 2 933 817 A1 10/2015

OTHER PUBLICATIONS

European Patent Office, "International Search Report and Written Opinion", PCT/US2017/015213, dated Apr. 13, 2017, 14 pages.

*Primary Examiner* — Truc Nguyen
(74) *Attorney, Agent, or Firm* — Eckert Seamans; David Jenkins; Grant Coffield

(57) ABSTRACT

A vacuum interrupter assembly is provided. The vacuum interrupter assembly includes an operating mechanism, a vacuum chamber including a number of bellows assemblies, a conductor assembly including a first contact assembly and a second contact assembly, the first contact assembly including a stem and a contact member, the first contact assembly stem including an elongated body with a proximal first end, a medial portion, and a distal second end. The first contact assembly stem body has a reduced length. The first contact assembly stem body having a reduced length generates less heat and electrical resistance.

14 Claims, 8 Drawing Sheets

(56) References Cited

U.S. PATENT DOCUMENTS

| | | | | | |
|---|---|---|---|---|---|
| 4,707,577 | A * | 11/1987 | Tamaki | H01H 33/6641 | 218/129 |
| 4,940,862 | A * | 7/1990 | Santilli | H01H 33/66261 | 218/136 |
| 5,691,522 | A * | 11/1997 | Schulman | H01H 33/18 | 218/128 |
| 5,793,008 | A * | 8/1998 | Mayo | H01H 33/6641 | 218/127 |
| 2007/0090095 | A1 | 4/2007 | Yoshida et al. | | |
| 2010/0032412 | A1* | 2/2010 | Trondsen | H01H 33/66261 | 218/136 |
| 2013/0119021 | A1* | 5/2013 | Li | H01H 33/6645 | 218/124 |
| 2014/0367363 | A1 | 12/2014 | Leusenkamp et al. | | |
| 2015/0332879 | A1* | 11/2015 | Leusenkamp | B23K 15/0046 | 218/118 |
| 2016/0141126 | A1* | 5/2016 | Kikuchi | B22F 3/02 | 218/127 |

* cited by examiner

VACUUM CIRCUIT INTERRUPTER

BACKGROUND OF THE INVENTION

Field of the Invention

The disclosed and claimed concept relates to a vacuum circuit breaker and, more specifically, to a vacuum circuit breaker wherein a movable, first contact assembly stem body has a reduced length.

Background Information

Circuit breakers and other such devices provide protection for electrical systems from electrical fault conditions such as current overloads, short circuits, and low level voltage conditions. In one embodiment, circuit breakers include a spring-powered operating mechanism which opens electrical contacts to interrupt the current through the conductors in an electrical system in response to abnormal conditions. In particular, vacuum circuit interrupters include separable main contacts disposed within an insulated and hermetically sealed vacuum chamber within a housing. Generally, a movable contact assembly is welded to a bellows that is part of the vacuum chamber. Thus, replacing the movable contact assembly, i.e., to change the operational characteristics of the vacuum circuit breaker, requires the destruction of the vacuum chamber.

The contacts are part of an electrode including a stem and a contact member. Generally, one of the electrodes is fixed relative to the housing. The other electrode is moveable relative to the housing and the other electrode. In a vacuum circuit interrupter, the moveable electrode assembly usually comprises a copper stem of circular cross-section having the contact member at one end enclosed within the vacuum chamber, and a driving mechanism at the other end which is external to the vacuum chamber. The stem of the movable contact has a length that is longer than 50%, i.e., greater than half, the length of the vacuum chamber housing in which it is partially disposed. Such stems have a mass that requires a robust operating mechanism capable of lifting such stems. That is, due to the mass of such stems, there is an increased cost in that the operating mechanism must be robust. Further, such stems have an expense related to their material cost.

Vacuum interrupters are, in one embodiment, used to interrupt medium voltage alternating current (AC) currents and, also, high voltage AC currents of several thousands of amperes or more. In one embodiment, one vacuum interrupter is provided for each phase of a multi-phase circuit and the vacuum interrupters for the several phases are actuated simultaneously by a common operating mechanism, or separately or independently by separate operating mechanisms. The electrodes can commonly take three positions: closed, opened and grounded.

When the electrodes are in the closed position, the contact members are in electrical communication and electricity flows therethrough. In this configuration, the electrodes become heated. The heat is, primarily generated in the stem of the electrode. That is, the stem is elongated and generally has a smaller cross-sectional area than the contact member. As such, electricity flowing through the stem creates heat and electrical resistance. The amount of heat and electrical resistance generated is a function of the cross-sectional area of the stems and the amount of current. That is, smaller electrodes and/or higher currents generate more heat.

Accordingly, using traditional electrodes, in order to have a circuit breaker rated at a higher current, the electrode must be larger.

Larger electrodes, however, have several disadvantages. For example, larger electrodes are more expensive and require a more robust operating mechanism, which is also more expensive. Further, a larger/more robust operating mechanism requires more energy to operate and is, therefore, more expensive to use as well. By way of example, the elongated movable contact assembly stem had a considerable mass that required a larger/more robust operating mechanism. If the elongated movable contact assembly stem was less massive, a less robust operating mechanism could be utilized.

There is, therefore, a need for an electrode that generates a reduced amount of heat and electrical resistance. There is a further need for a vacuum circuit breaker wherein the operational characteristics of the vacuum interrupter assembly can be changed without removing the movable contact assembly from the vacuum interrupter assembly. There is a further need for a vacuum circuit breaker including an actuator link member body having a reduced mass. There is a further need for a stem for a movable contact that has a reduced length and associated mass.

SUMMARY OF THE INVENTION

These needs, and others, are met by at least one embodiment of the disclosed and claimed concept which provides for a vacuum interrupter assembly including an operating mechanism, a vacuum chamber including a number of bellows assemblies, a conductor assembly including a first contact assembly and a second contact assembly, the first contact assembly including a stem and a contact member, the first contact assembly stem including an elongated body with a proximal first end, a medial portion, and a distal second end, the first contact assembly contact coupled to, and in electrical communication with, the first contact assembly stem body second end, the first contact assembly contact disposed in the vacuum chamber, the second contact assembly including a stem and a contact member, the second contact assembly stem including an elongated body with a proximal first end, a medial portion, and a distal second end, the second contact assembly contact coupled to, and in electrical communication with, the second contact assembly stem body second end, the second contact assembly contact disposed in the vacuum chamber, the operating mechanism operatively coupled to the first contact assembly stem body first end, wherein the first contact assembly contact is structured to move between a first position, wherein the first contact assembly contact is not directly coupled to the second contact assembly contact, and a second position, wherein the first contact assembly contact is coupled to, and in electrical communication with the second contact assembly contact, and wherein the first contact assembly stem body has a reduced length. The first contact assembly stem body having a reduced length generates less heat and electrical resistance.

The first contact assembly stem body has a reduced length due to the use of a flex connection assembly that is disposed inside of a seal cup. That is, the use of the flex connection assembly and its position between the first contact assembly and an associated terminal allows for the first contact assembly stem body to have a reduced length. That is, the use of, and position of, the flex connection assembly solves the problems stated above. Further, with a first contact assembly stem body having a reduced length, the operating mechanism includes an elongated actuator link member that couples the first contact assembly stem body to the operating mechanism. That is, rather than having a massive elongated copper stem, the disclosed concept includes an elongated actuator link member body having a reduced mass. This configuration also solves the problems stated above.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
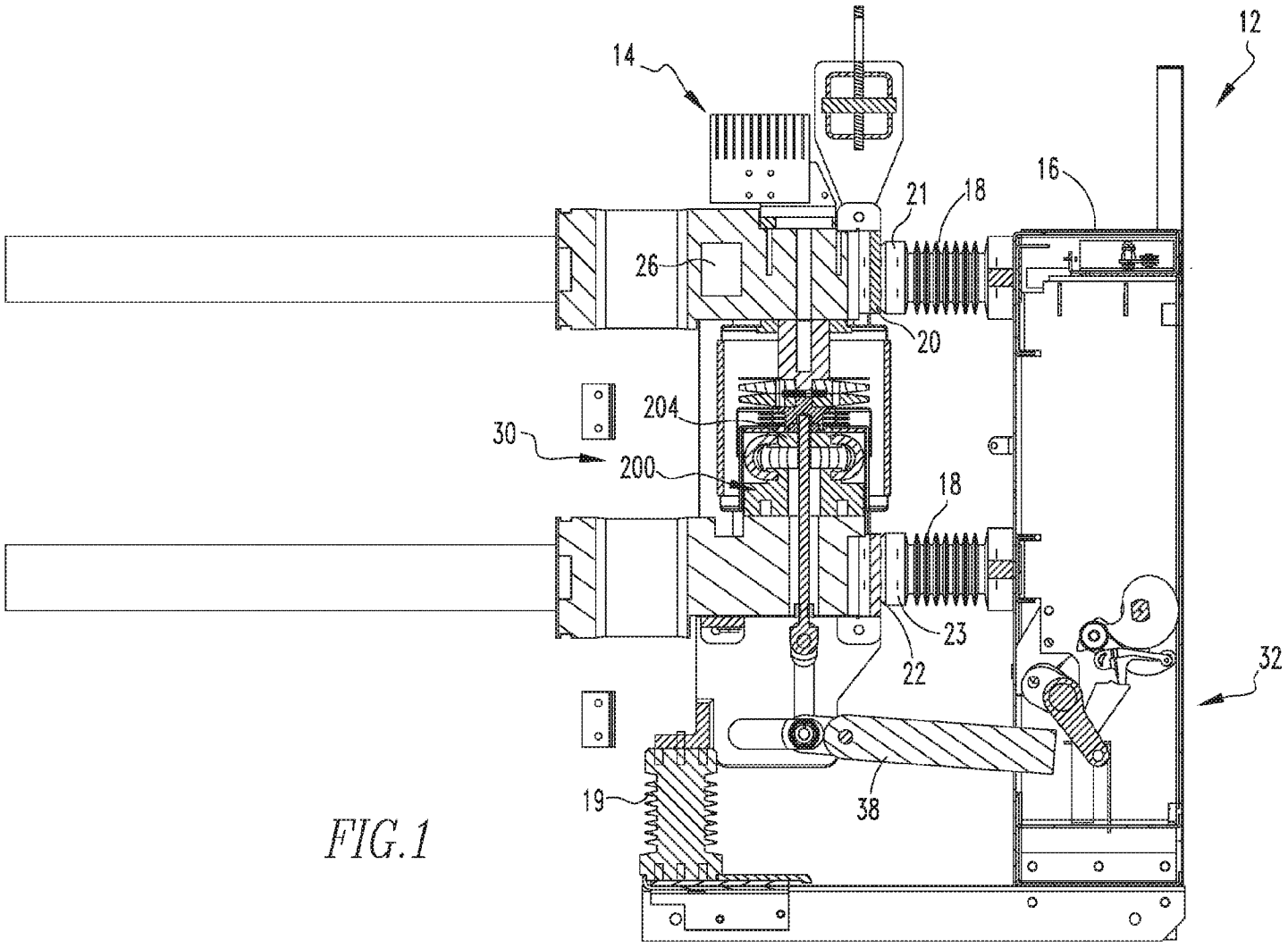
FIG. 1 is a schematic, partially cross-sectional side view of a vacuum circuit breaker.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations, assembly, number of components used, embodiment configurations and other physical characteristics related to the embodiments disclosed herein are not to be considered limiting on the scope of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof. Further, an object resting on another object held in place only by gravity is not "coupled" to the lower object unless the upper object is otherwise maintained substantially in place. That is, for example, a book on a table is not coupled thereto, but a book glued to a table is coupled thereto.

As used herein, the phrase "removably coupled" means that one component is coupled with another component in an essentially temporary manner. That is, the two components are coupled in such a way that the joining or separation of the components is easy and would not damage the components. For example, two components secured to each other with a limited number of readily accessible fasteners, i.e., fasteners that are not difficult to access, are "removably coupled" whereas two components that are welded together or joined by difficult to access fasteners are not "removably coupled." A "difficult to access fastener" is one that requires the removal of one or more other components prior to accessing the fastener wherein the "other component" is not an access device such as, but not limited to, a door.

As used herein, "operatively coupled" means that a number of elements or assemblies, each of which is movable between a first position and a second position, or a first configuration and a second configuration, are coupled so that as the first element moves from one position/configuration to the other, the second element moves between positions/configurations as well. It is noted that a first element may be "operatively coupled" to another without the opposite being true.

As used herein, a "coupling assembly" includes two or more couplings or coupling components. The components of a coupling or coupling assembly are generally not part of the same element or other component. As such, the components of a "coupling assembly" may not be described at the same time in the following description.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component is a nut.

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are to fit "snugly" together. In that situation, the difference between the size of the components is even smaller whereby the amount of friction increases. If the element defining the opening and/or the component inserted into the opening are made from a deformable or compressible material, the opening may even be slightly smaller than the component being inserted into the opening. With regard to surfaces, shapes, and lines, two, or more, "corresponding" surfaces, shapes, or lines have generally the same size, shape, and contours.

As used herein, the statement that two or more parts or components "engage" one another shall mean that the elements exert a force or bias against one another either directly or through one or more intermediate elements or components. Further, as used herein with regard to moving parts, a moving part may "engage" another element during the motion from one position to another and/or may "engage" another element once in the described position. Thus, it is understood that the statements, "when element A moves to element A first position, element A engages element B," and "when element A is in element A first position, element A engages element B" are equivalent statements and mean that element A either engages element B while moving to element A first position and/or element A either engages element B while in element A first position.

As used herein, "operatively engage" means "engage and move." That is, "operatively engage" when used in relation to a first component that is structured to move a movable or rotatable second component means that the first component applies a force sufficient to cause the second component to move. For example, a screwdriver may be placed into contact with a screw. When no force is applied to the screwdriver, the screwdriver is merely "coupled" to the screw. If an axial force is applied to the screwdriver, the screwdriver is pressed against the screw and "engages" the screw. However, when a rotational force is applied to the screwdriver, the screwdriver "operatively engages" the screw and causes the screw to rotate. Further, with electronic components, "operatively engage" means that one component controls another component by a control signal or current.

As used herein, the word "unitary" means a component that is created as a single piece or unit. That is, a component that includes pieces that are created separately and then coupled together as a unit is not a "unitary" component or body.

As used herein, the term "number" shall mean one or an integer greater than one (i.e., a plurality).

As used herein, "about" in a phrase such as "disposed about [an element, point or axis]" or "extend about [an element, point or axis]" or "[X] degrees about an [an element, point or axis]," means encircle, extend around, or measured around. When used in reference to a measurement or in a similar manner, "about" means "approximately."

As used herein, "associated" means that the elements are part of the same assembly and/or operate together, or, act upon/with each other in some manner. For example, an automobile has four tires and four hub caps. While all the elements are coupled as part of the automobile, it is understood that each hubcap is "associated" with a specific tire.

As used herein, in the phrase "[x] moves between its first position and second position," or, "[y] is structured to move [x] between its first position and second position," "[x]" is the name of an element or assembly. Further, when [x] is an element or assembly that moves between a number of positions, the pronoun "its" means "[x]," i.e., the named element or assembly that precedes the pronoun "its."

As used herein, "structured to [verb]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies. As such, as used herein, "structured to [verb]" recites structure and not function. Further, as used herein, "structured to [verb]" means that the identified element or assembly is intended to, and is designed to, perform the identified verb. Thus, an element that is merely capable of performing the identified verb but which is not intended to, and is not designed to, perform the identified verb is not "structured to [verb]."

Figure 2:
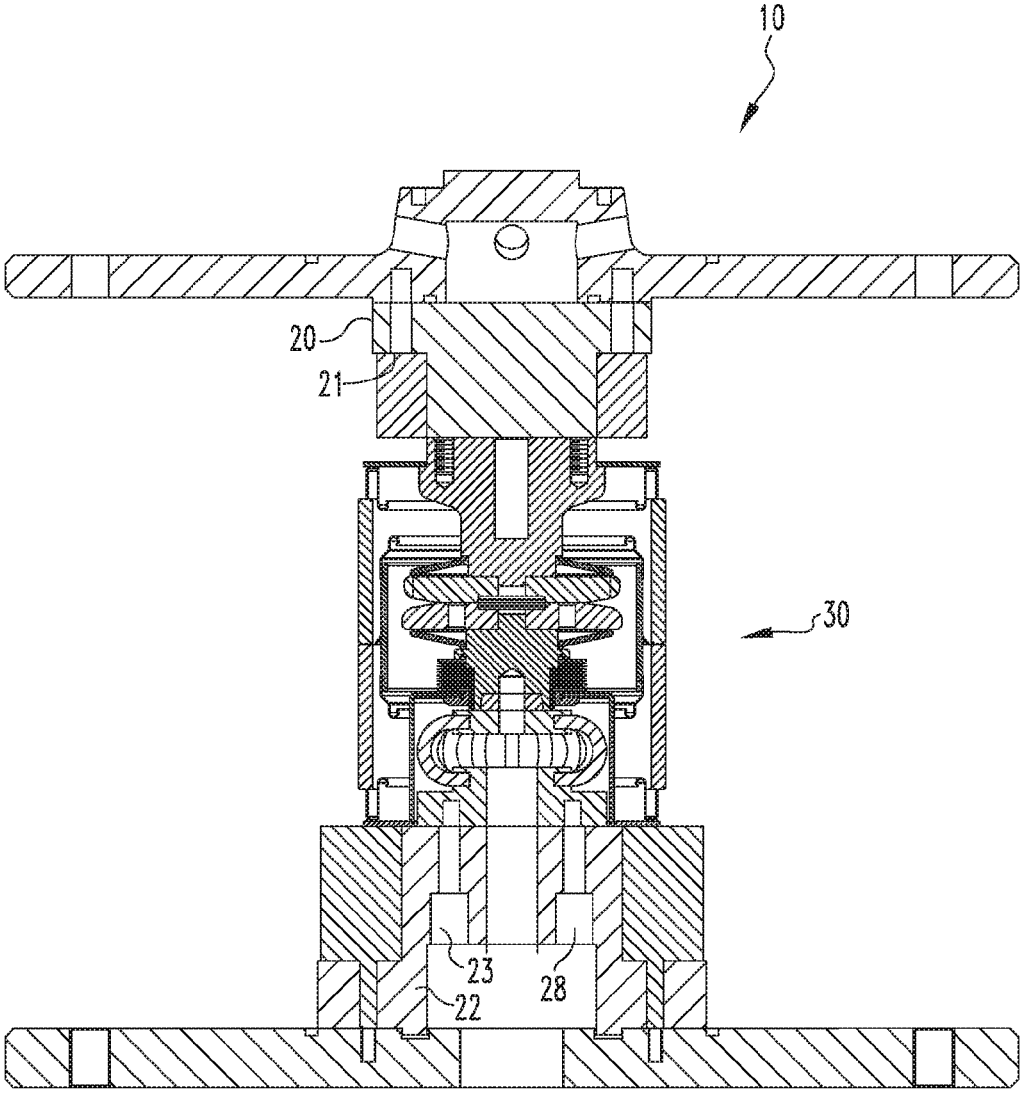
FIG. 2 is a schematic, partially cross-sectional front view of a vacuum circuit breaker.

Referring to FIGS. 1 and 2, there is illustrated a vacuum circuit breaker 10 incorporating a vacuum interrupter assembly 30. As is known, the vacuum circuit breaker 10 may be a single pole or multi-pole vacuum circuit breaker 10. Hereinafter, and as an exemplary embodiment, only a single pole will be discussed. It is, however, understood that the claims are not limited to an embodiment having only a single pole. Generally, the vacuum circuit breaker 10, in an exemplary embodiment, includes a low voltage portion 12 and a high voltage portion 14. The low voltage portion 12 includes a housing 16 structured to include a control device (not shown) such as, but not limited to, a circuit breaker assembly and/or a control panel for manually operating the vacuum circuit breaker 10 and changing the state of the contact assemblies 150, 160 (discussed below) to either an open or closed condition. The low voltage portion 12 is operatively coupled to the high voltage portion 14 via stand-off supports 18. The high voltage portion 14 includes a line terminal 20, a load terminal 22, and the vacuum interrupter assembly 30. The line terminal 20 is structured to be, and is, coupled to a line (not shown) and includes a fixed coupling 21. The load terminal 22 is structured to be, and is, coupled to a load (not shown) and includes a fixed coupling 23. Either, or both, of the line terminal 20, and/or load terminal 22 includes a heat sink 26, shown schematically. In an exemplary embodiment, the line terminal coupling 21 and the load terminal coupling 23 are in a "fixed" location. That is, as used herein in reference to electrical terminal couplings 21, 23, "fixed" means that during operation of the vacuum circuit breaker 10, the conductive couplings 21, 23 of the terminals 20, 22 do not move relative to other elements of the vacuum circuit breaker 10. As shown, the elements of the high voltage portion 14 are, in an exemplary embodiment, supported by insulated rods 19.

Figure 3:
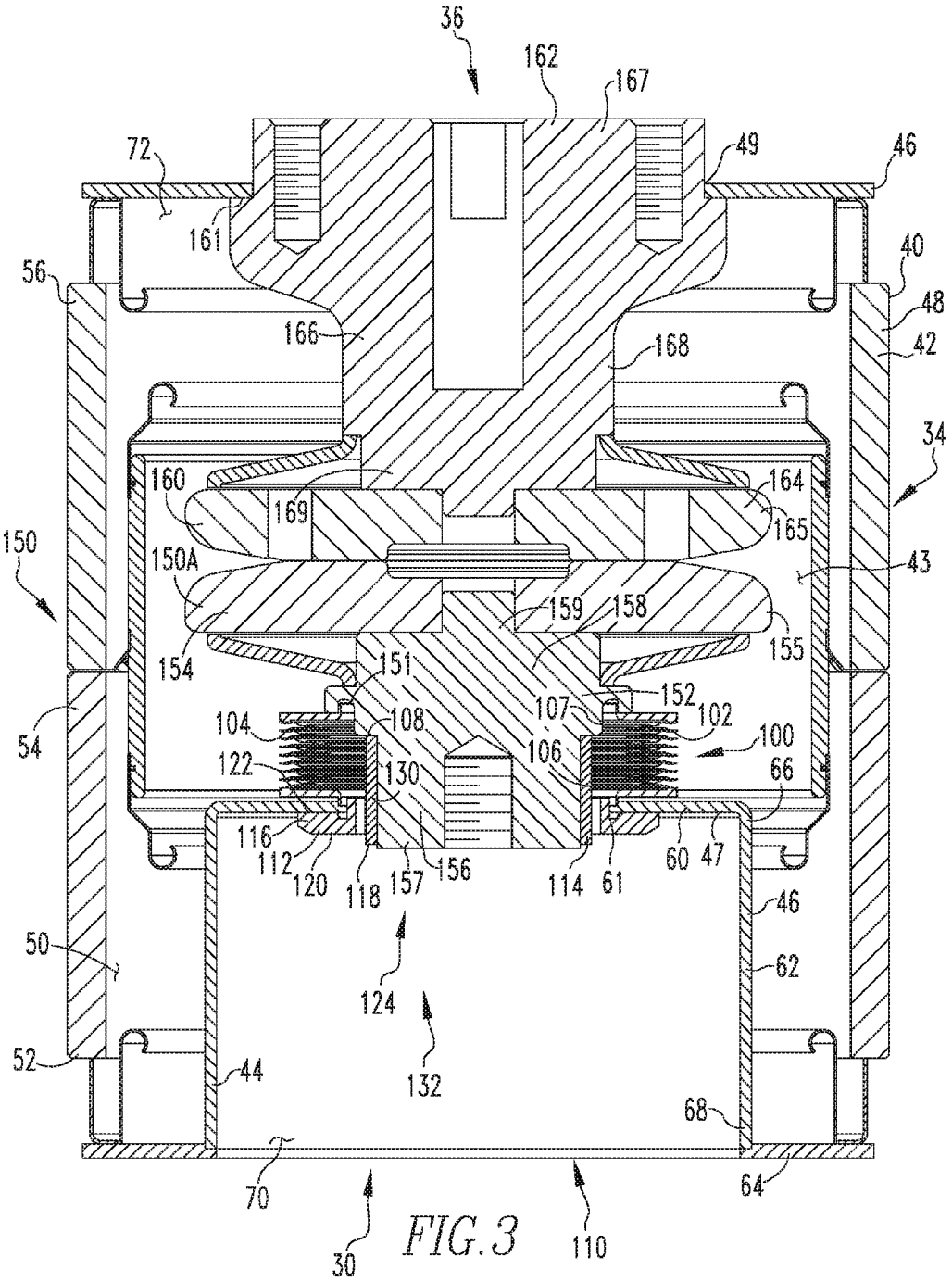
FIG. 3 is a cross-sectional front view of a vacuum interrupter assembly.

The vacuum interrupter assembly 30, as shown in FIG. 3 and in an exemplary embodiment, includes an operating mechanism 32 (shown schematically, FIG. 1), a vacuum chamber 34 and a conductor assembly 36. The operating mechanism 32 is structured to, and does, move a number of movable contact assemblies 150A, 150B between a first position, wherein each movable contact assembly 150A, 150B is spaced from, and are not in electrical communication with, another contact 150A, 150B, 160, and, a second position wherein each movable contact 150A, 150B is coupled to, and in electrical communication with, another contact 150A, 150B, 160, as discussed below.

In an exemplary embodiment, the operating mechanism 32 includes an actuator link member 38 having a body 39. As used herein, the "actuator link member" is the largest linkage member of the operating mechanism 32 which imparts motion to the movable contact assembly 150, discussed below. The actuator link member 38 is structured to be, and is, operatively coupled to the movable contact assembly 150, or movable contact assemblies 150A, 150B, and is structured to move the movable contact assembly 150 between a first and second position, described below. That is, the actuator link member 38 imparts mechanical motion to the movable contact assembly 150. In an exemplary embodiment, the actuator link member 38 is made from a non-conductive material or a combination of conductive and non-conductive materials. The actuator link member 38 has a "reduced mass." As used herein, and in reference to an embodiment wherein the actuator link member 38 is made from a non-conductive material or a combination of conductive and non-conductive materials, a "reduced mass" means an actuator link member has a mass that is between about 30% to 90%, or about 60% less than an actuator link member made of a conductive material and having substantially similar dimensions. In another exemplary embodiment, the actuator link member 38 is made from a conductive material. In an embodiment wherein the actuator link member 38 is made from a conductive material, the actuator link member 38 may still have a "reduced mass." That is, in an embodiment wherein the actuator link member 38 is made from a conductive material, a "reduced mass" means an actuator link member has a mass that is between about 30% to 90%, or about 60% relative to a prior art actuator link member that is structured to extend between elements of the operating mechanism 32 and the movable contact assembly 150. The reduction in mass is accomplished by providing an actuator link member 38 having a reduced diameter or length. In an embodiment including a "reduced mass" actuator link member 38 having a "reduced mass," the reduction in mass solves the problems stated above.

The vacuum chamber 34 includes a housing assembly 40 including a sidewall 42 and a number of seal cups 44, 46. In an exemplary embodiment, the sidewall 42 is a hollow, generally cylindrical body 48. In this configuration, the vacuum chamber housing assembly sidewall 42 defines a generally enclosed space 50, hereinafter "vacuum chamber enclosed space 50." Further, the vacuum chamber housing assembly sidewall 42 has a first end 52, a medial portion 54, and a second end 56. In this configuration, the housing assembly 40 has a length measured from vacuum chamber housing assembly sidewall first end 52 to the vacuum chamber housing assembly sidewall second end 56.

In an exemplary embodiment, there is a first seal cup 44 and a second seal cup 46. In an exemplary embodiment, each seal cup 44', 46' associated with a movable contact assembly 150 includes a generally circular planar portion 60, a sidewall 62 that extends generally perpendicular to the plane of the associated seal cup planar portion 60, and a flange 64 that extends generally parallel to the plane of the associated seal cup planar portion 60. The seal cup planar portion 60, in an exemplary embodiment, includes a central opening 61 disposed generally at the center of the generally circular seal cup planar portion 60. In an exemplary embodiment, the seal cup sidewall 62 extends from the periphery of the generally circular seal cup planar portion 60 and, as such, is generally cylindrical. The seal cup sidewall 62 includes a proximal end 66, which is coupled to the seal cup planar portion 60, and a distal end 68 opposite the seal cup sidewall proximal end 66. In an exemplary embodiment, the seal cup flange 64 extends radially outwardly from the seal cup sidewall distal end 68.

A second seal cup 46 associated with a fixed contact assembly 160, described below, includes a generally planar, torus-shaped body 47 defining a central opening 49. The second seal cup body opening 49 is sized to closely correspond to the cross-sectional area of the fixed, second contact assembly stem body medial portion 168.

In an exemplary embodiment, each seal cup 44, 46 is a unitary body. Further, in this configuration, each seal cup 44, 46 defines a generally enclosed space 70, 72, respectively. It is noted that, while the seal cups 44, 46 are similar, the seal cup sidewall 62 of a seal cup 44 associated, i.e., disposed adjacent a movable contact 150, has a greater height relative to the seal cup planar portion 60 when compared to a seal cup sidewall 62 of a seal cup 46 associated, i.e., disposed adjacent a fixed contact 160.

Each seal cup 44, 46 is sealingly coupled to vacuum chamber housing assembly sidewall 42. In an exemplary embodiment, each seal cup 44 associated with a movable contact assembly 150 is disposed in an inverted orientation in the vacuum chamber housing assembly sidewall 42. That is, as used herein, "in an inverted orientation" when used in reference to a cup seal means that the generally enclosed space 50 defined by a seal cup 44 is disposed substantially within the vacuum chamber enclosed space 43. Each seal cup flange 64 is sealingly coupled to the vacuum chamber housing assembly sidewall 42. That is, as shown, the first seal cup 44 is disposed at the vacuum chamber housing assembly sidewall first end 52 and the second seal cup 46 is disposed at the vacuum chamber housing assembly sidewall second end 56.

As discussed below, one embodiment of the vacuum interrupter assembly 30 includes two movable contact assemblies 150A, 150B. In a first embodiment, however, there is a single movable contact assembly 150A. As is known, to accommodate movable contact assembly 150A a vacuum chamber 34 includes an element that allows for movement of the movable contact. In an exemplary embodiment, the element that allows for movement of the movable contact is a bellows assembly 100. In an exemplary embodiment, the bellows assembly 100 is a metal weld bellows 102. As is known, a bellows for a vacuum chamber 34 includes a generally cylindrical sidewall having an accordion-like shape defining a number of corrugations. As used herein, a "single seam bellows" includes a sidewall cast or shaped with the number of corrugations, the sidewall is then formed into a generally cylindrical shape and the ends are welded together along a single seam. As used herein, a "metal weld bellows" includes a number of generally planar, torus-like body members and a number of torus-like spring members; the spring members generally extend from the outer edge of one body member to the inner edge of an adjacent body member. In this configuration, the spring members and body members define a number of corrugations. The spring members are sealingly coupled, such as, but not limited to, by welding the spring members to the body members. It is understood that the spring members and the body members are generally torus shaped, the members may include a shape so as to enhance the resiliency of the metal weld bellows. In an exemplary embodiment having a single movable contact 150, a first bellows assembly 100A is associated with a first movable contact 150A.

Each bellows assembly 100 includes a body 104 having a first end 106 a second end 107, and defines a passage 108. As described above, the bellows assembly body 104 is, in an exemplary embodiment, generally cylindrical and includes a number of corrugations. Thus, the bellows assembly body passage 108 alternates between a minimum inner radius and a maximum inner radius.

In an exemplary embodiment, each bellows assembly 100 includes an anti-twist bushing assembly 110. The bushing assembly 110 includes a collar portion 112 and a sheath portion 114. In an exemplary embodiment, the anti-twist bushing assembly collar portion 112 includes a generally planar body 116 defining a generally circular central opening 118. The bushing assembly collar portion body central opening 118 generally corresponds to the first contact assembly stem body first end 157, discussed below. In an exemplary embodiment, the bushing assembly collar portion body 116 is also generally circular and has a larger radius than the seal cup planar portion central opening 61. Further, in an exemplary embodiment, the bushing assembly collar portion body 116 includes a first planar surface 120, an opposing second planar surface 122 and a number of fluid passages 124 extending therebetween. As shown, and in an exemplary embodiment, the bushing assembly collar portion body fluid passages 124 are disposed in a pattern that is generally symmetric about the center of the bushing assembly collar portion body central opening 118. It is understood that the term "symmetric about the center" relates to rotational symmetry.

The bushing assembly sheath portion 114 includes a hollow, generally cylindrical body 130. The bushing assembly sheath portion body 130 defines a passage 132 that is sized to generally correspond to the first contact assembly stem body first end 157 and the first contact assembly stem body medial portion 158, discussed below. The bushing assembly sheath portion body 130 is disposed about, i.e., generally encircling, bushing assembly collar portion body central opening 118 and is contiguous therewith. The bushing assembly 110 is, in an exemplary embodiment, a unitary body. That is, the bushing assembly collar portion 112 and the bushing assembly sheath portion 114 are unitary.

Figure 4A:
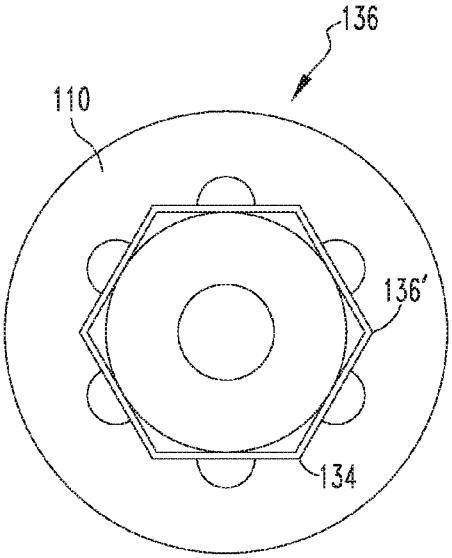
FIG. 4A is a schematic top view of one embodiment of an anti-rotation assembly.
Figure 4C:
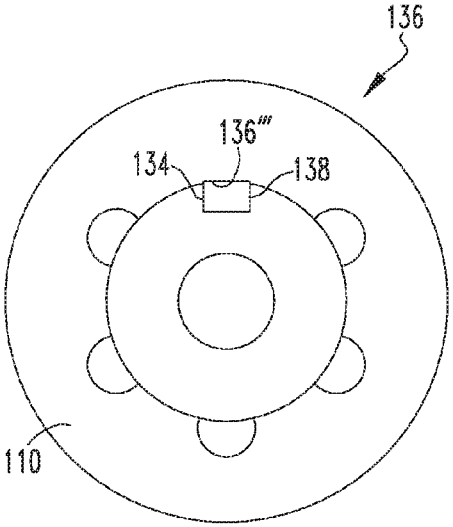
FIG. 4C is a schematic top view of another embodiment of an anti-rotation assembly.
Figure 4B:
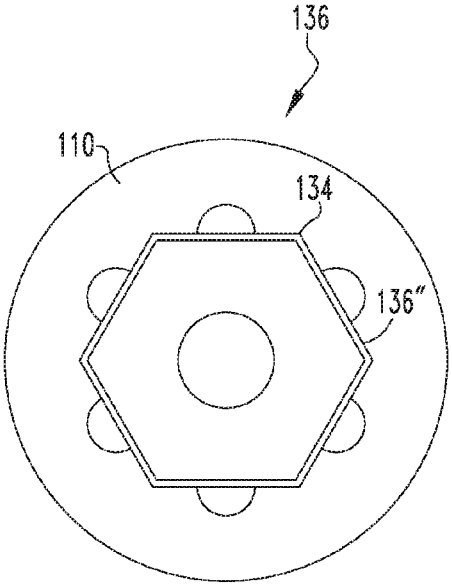
FIG. 4B is a schematic top view of another embodiment of an anti-rotation assembly.
Figure 4D:
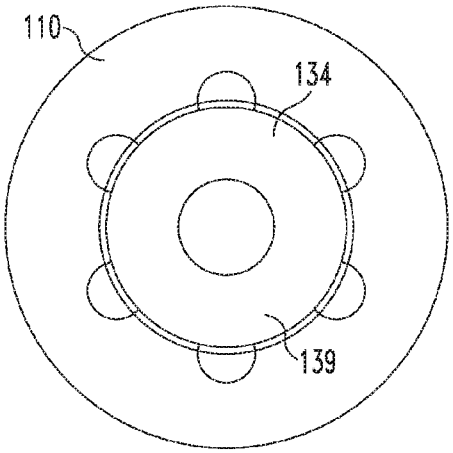
FIG. 4D is a schematic top view of another embodiment of an anti-rotation assembly.

The bushing assembly 110 further includes an anti-rotation assembly 134. The anti-rotation assembly 134 includes a component on the first contact assembly stem body first end 157 and/or the first contact assembly stem body medial portion 158 which, for the purpose of this discussion, are identified as part of the anti-rotation assembly 134. The anti-rotation assembly 134 is structured to resist, and in an exemplary embodiment prevent, rotation of the bushing assembly 110 relative to the first contact assembly stem 152. As shown in FIGS. 4A-4D, the anti-rotation assembly 134 includes a non-circular element 136 coupled to, or formed as part of, the first contact assembly stem body first end 157 and/or the first contact assembly stem body medial portion 158. Further, the bushing assembly collar portion 112 and/or sheath portion 114 defines a cavity 138 corresponding to the anti-rotation assembly non-circular element 136. For example, the anti-rotation assembly non-circular element 136 may be a nut 136' (FIG. 4A) coupled to the first contact assembly stem 152, a non-circular portion 136" (FIG. 4B) incorporated into the first contact assembly stem 152, or a lug 136''' (FIG. 4C) coupled to, or incorporated into, the first contact assembly stem 152. Alternatively, as shown in FIG. 4D, the first contact assembly stem 152 and the anti-twist bushing assembly collar portion body opening 118 and/or the bushing assembly sheath portion body passage 132 each define a friction surface 139. It is understood that when the bushing assembly 110 is disposed on the first contact assembly stem 152, the components of the anti-rotation assembly 134 are coupled, directly coupled, or fixed to each other and resist, or prevent, rotation of the bushing assembly 110 relative to the first contact assembly stem 152.

Figure 8:
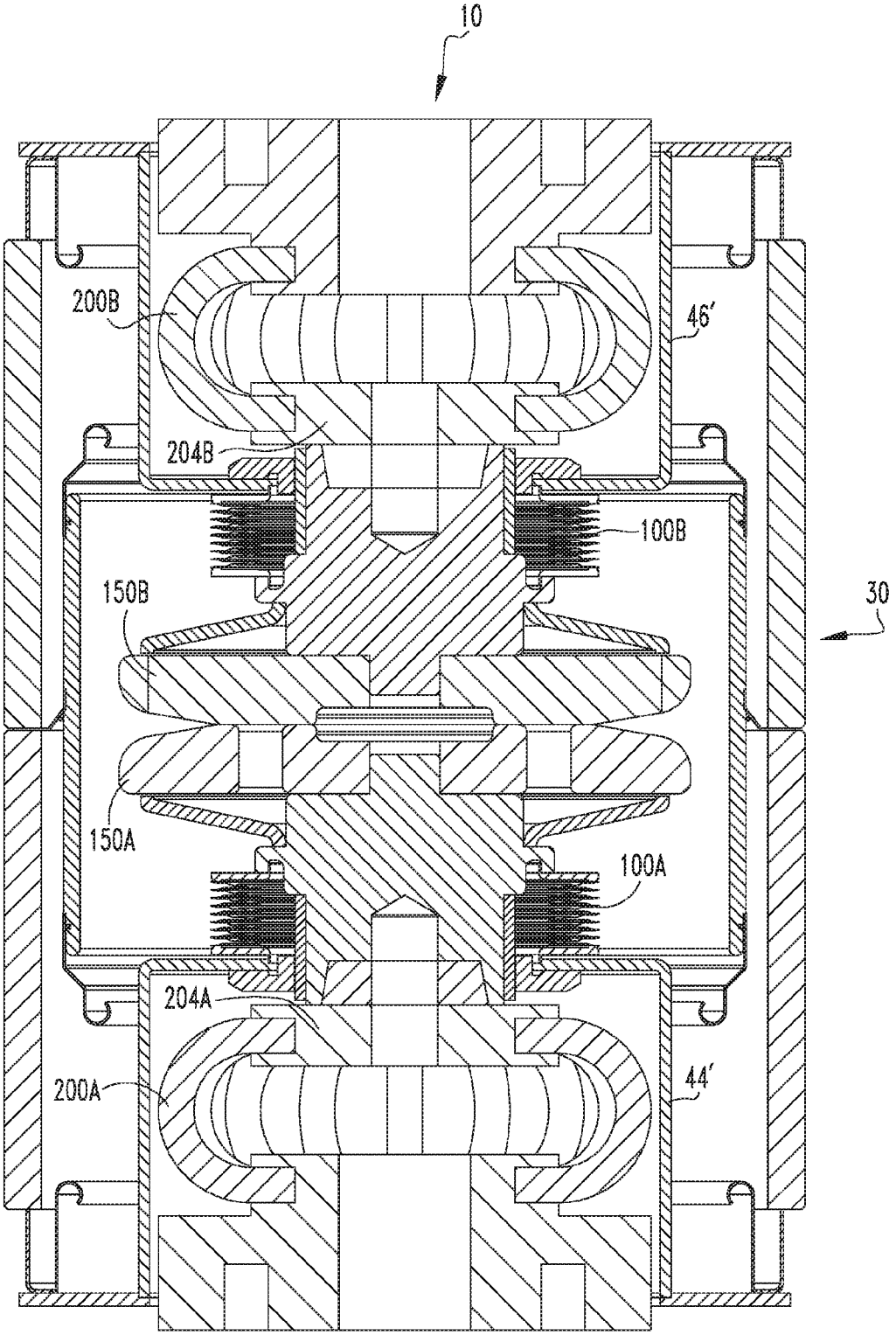
FIG. 8 is a cross-sectional view of an alternate embodiment with two movable contact assemblies.

It is understood that in an embodiment with two movable contact assemblies 150A, 150B, there are two bellows assemblies, i.e., a first bellows assembly 100A, as described above, and a second bellows assembly 100B (FIG. 8). That is, in an embodiment with two movable contact assemblies 150A, 150B (FIG. 8) there is a second bellows assembly 100B. The second bellows assembly 100B will not be described in detail herein but it is understood that the second bellows assembly 100B' is substantially similar to the first bellows assembly 100A.

The conductor assembly 36 includes the conductive elements of the vacuum interrupter assembly 30. In an exemplary embodiment, the conductor assembly 36 includes a first contact assembly 150A, a second contact assembly 150B (FIG. 8) or 160 (FIG. 3), and a number of flex connection assemblies 200. In an exemplary embodiment, a first contact assembly 150A is movable relative to the vacuum chamber 34 whereas the second contact assembly 160 is stationary relative to the vacuum chamber 34. In another embodiment, discussed below, both the first and second contact assemblies 150A, 150B are movable relative to the vacuum chamber 34. Accordingly, for the embodiment discussed immediately below, the first contact assembly 150A is, as used herein, a "movable, first contact assembly 150A" or alternately a "movable contact assembly 150." Conversely, for the embodiment discussed immediately below, the second contact assembly 160 is, as used herein, a "fixed, second contact assembly 160" or alternately a "fixed contact assembly 160." In another embodiment including two movable contact assemblies, discussed further below, there is the first contact assembly 150 is, as used herein, a "movable, first contact assembly 150A." Further, in the embodiment including two movable contact assemblies, the second contact assembly 160 is alternately identified by reference number 150B and is, as used herein, the "movable, second contact assembly 150B."

Each contact assembly 150, 160 includes a stem 152, 162 and a contact member 154, 164. Each contact assembly stem 152, 162 includes an elongated body 156, 166. Each contact assembly stem body 156, 166 includes a proximal first end 157, 167, a medial portion 158, 168, and a distal, second end 159, 169. In an exemplary embodiment, each contact assembly stem body 156, 166 has a generally circular cross-section. Each contact assembly contact member 154, 164 includes, in an exemplary embodiment, a generally circular, disk-like body 155, 165. Each contact assembly stem 152, 162 and contact assembly contact member 154, 164 is made from a conductive material such as, but not limited to, copper. The first contact assembly contact member 154 is coupled to, and in electrical communication with, the first contact assembly stem second end 159. The second contact assembly contact member 164 is coupled to, and in electrical communication with, the second contact assembly stem second end 169.

Further, in an exemplary embodiment, each contact assembly stem body 156, 166 includes a number of "flanges" 151, 161. As used herein, a "flange" on a contact assembly stem body 156, 166 is a change in radius whereby a generally radially extending surface is created on the contact assembly stem body 156, 166. The change in radius may be an increase in the radius or a decrease in the radius. The contact assembly stem body flanges 151, 161 act as mounting surfaces and/or coupling surfaces.

In an exemplary embodiment, by utilizing a metal weld bellows 102 and a first flex connection assembly 200A, described below, the movable, first contact assembly stem 152 has a "reduced length." As used herein, a "reduced length" in relation to a contact assembly stem means that the stem has a length that is between 0% to less than 50% the length of the housing assembly 40. The reduced length, and the associated reduction in mass, of the first contact assembly stem 152 solves the problem(s) stated above.

Figure 5:
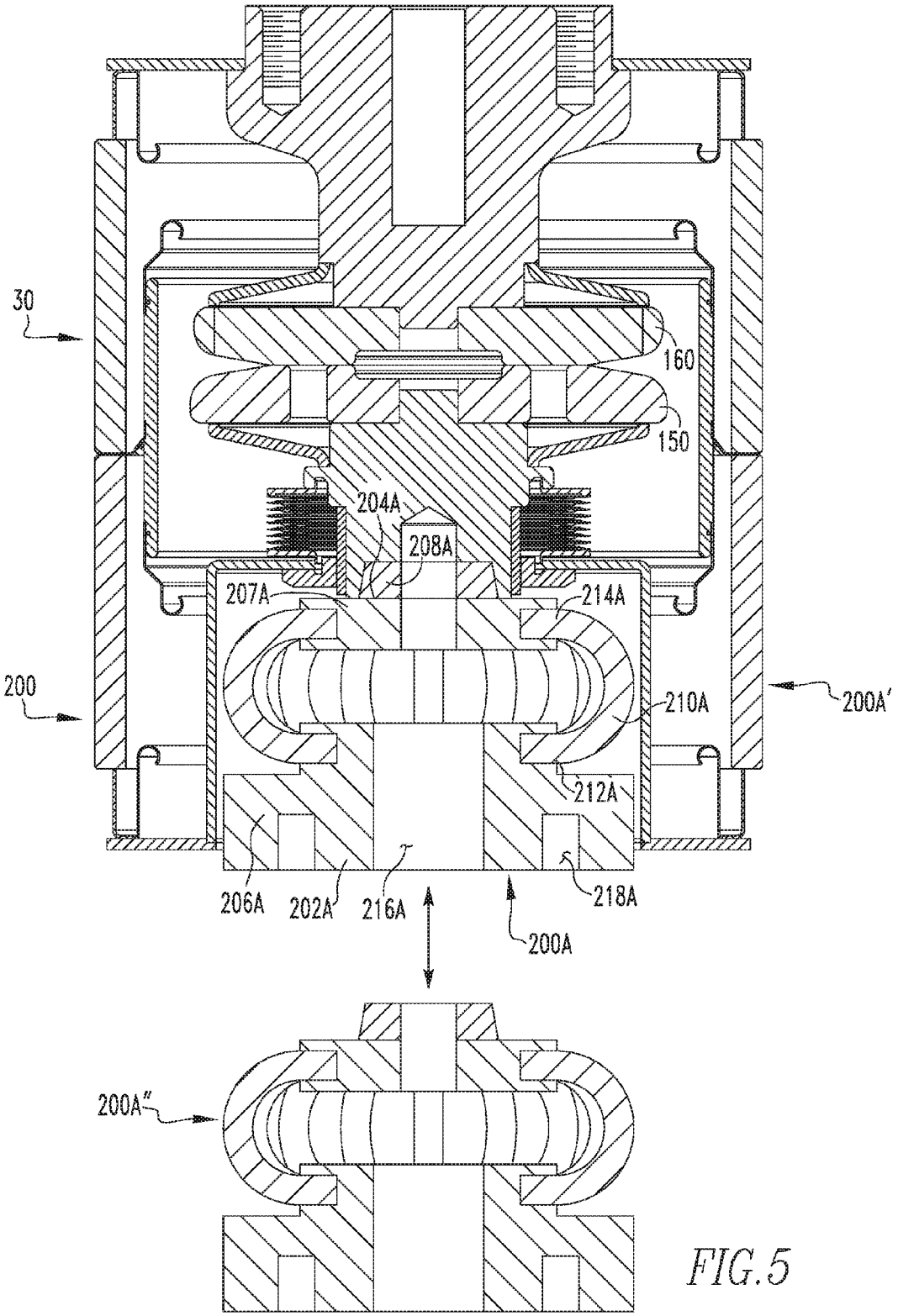
FIG. 5 is a schematic cross-sectional side view of a flex connection assembly.
Figure 6A:
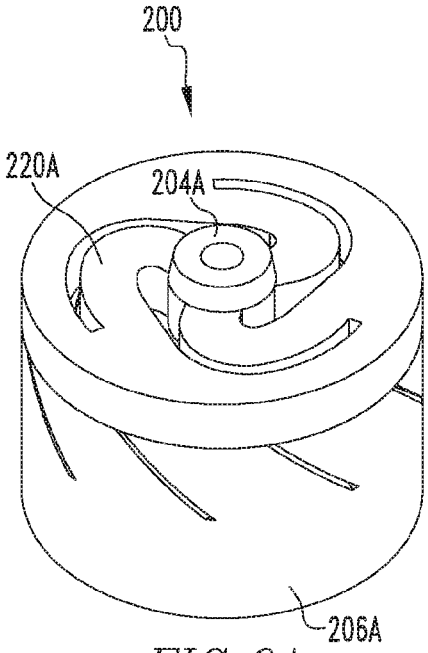
FIG. 6A is an isometric view of one embodiment of a flex connection assembly.
Figure 6B:
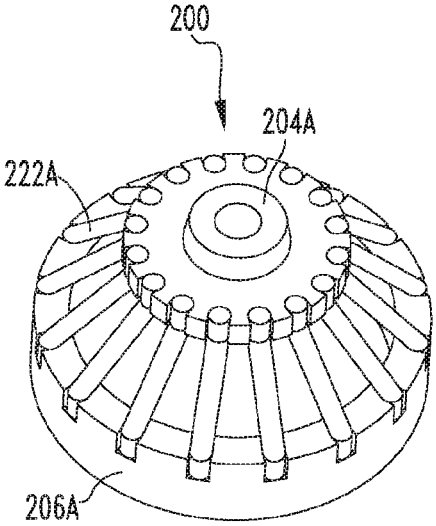
FIG. 6B is an isometric view of another embodiment of a flex connection assembly.
Figure 6C:
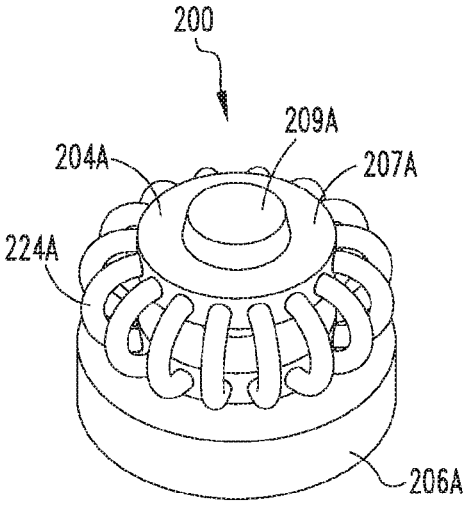
FIG. 6C is an isometric view of another embodiment of a flex connection assembly.

As shown in FIG. 5, a flex connection assembly 200 is associated with each movable contact 150A, 150B Thus, in an embodiment with a single, first movable contact 150A, there is a single first flex connection assembly 200A. In an exemplary embodiment, the first flex connection assembly 200A includes a fixed coupling 202A and a movable coupling 204A. In an exemplary embodiment, the first flex connection assembly fixed coupling 202A is a conductive body 206A having a first radius, diameter or width. In one embodiment, the first flex connection assembly fixed coupling body 206A is generally a torus (FIGS. 6A-6B). In another embodiment, the first flex connection assembly fixed coupling body 206A is generally star-shaped, but defines a central opening (not shown). That is, the first flex connection assembly fixed coupling body 206A defines a central opening in both embodiments. The first flex connection assembly movable coupling 204A is a conductive body 208A having a second radius, diameter or width. The second radius, diameter or width is, in an exemplary embodiment, smaller than the first radius, diameter or width. The first flex connection assembly movable coupling conductive body 208A is, in an exemplary embodiment shown in FIGS. 5 and 6C, a unitary tiered torus construct having a lower torus 207A and an upper torus 209A. In other embodiments, shown in FIG. 6D, the first flex connection assembly movable coupling conductive body 208A includes a hexagonal portion 205A and an upper torus 209A.

Figure 6D:
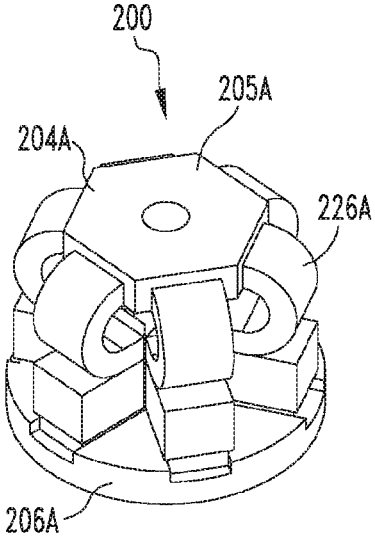
FIG. 6D is an isometric view of another embodiment of a flex connection assembly.

The first flex connection assembly fixed coupling 202A and the first flex connection assembly movable coupling 204A are coupled to, and in electrical communication with, each other. That is, the first flex connection assembly 200A further includes, in an exemplary embodiment, a number of flexible conductors 210A. In another embodiment, the first flex connection assembly 200A further includes a plurality of flexible conductors 210A. Each first flex connection assembly flexible conductor 210A includes a first end 212A and a second end 214A. Each first flex connection assembly flexible conductor first end 212A is coupled to, and in electrical communication with, the first flex connection assembly fixed coupling 202A. Each first flex connection assembly flexible conductor second end 214A is coupled to, and in electrical communication with, the first flex connection assembly movable coupling 204A. In an exemplary embodiment, the first flex connection assembly flexible conductors 210A are disposed about, i.e., generally encircling, a selected point. In an exemplary embodiment, the first contact assembly stem body first end includes a center "C" and the number of first flex connection assembly flexible conductors 210A are disposed about the first contact assembly stem body first end center "C." As shown in FIGS. 6A-6D, the number of first flex connection assembly flexible conductors 210A may have several configurations such as, but not limited to, spiral members 220A (FIG. 6A), tapered members 222A (FIG. 6B), cylindrical (in cross-section) curved members 224A (FIG. 6C), or rectangular (in cross-section) curved members 226A (FIG. 6D).

It is further noted that the configuration of the flex connection assembly 200, such as, but not limited to, the size of the first flex connection assembly fixed coupling body 206A, the size of the first flex connection assembly movable coupling conductive body 208A, the number of flexible conductors 210A, the size and/or shape of the flexible conductors 210A, affect the characteristics of the flex connection assembly 200 which, in turn, affect the characteristics of the vacuum chamber 34. The characteristics of the vacuum chamber 34 having the flex connection assembly 200 include: a carrying current up to about 10,000 A as a continuously rated current; a peak withstand current up to about 100 Ka for 3 s and a peak making current up to about 274 Ka. These characteristics further occur without any de-brazing or deformation of any of the elements of the conductor assembly 36.

In this configuration, the flex connection assembly 200 is structured to move between two configurations, a first configuration, wherein the first flex connection assembly movable coupling conductive body 208A is disposed closer to the first flex connection assembly fixed coupling body 206A, and a second configuration, wherein the first flex connection assembly movable coupling conductive body 208A is spaced from the first flex connection assembly fixed coupling body 206A. It is understood that "closer to" and "spaced from" are relative terms meaning that when the flex connection assembly 200 is in the first configuration, the first flex connection assembly movable coupling conductive body 208A is disposed closer to the first flex connection assembly fixed coupling body 206A when compared to the flex connection assembly 200 in the second configuration. Conversely, when the flex connection assembly 200 is in the second configuration, the first flex connection assembly movable coupling conductive body 208A is disposed further, i.e., spaced, from to the first flex connection assembly fixed coupling body 206A when compared to the flex connection assembly 200 in the first configuration.

In one exemplary embodiment, a flex connection assembly 200 is structured to be, and is, fixed to the associated contact assembly 150, 160 and, more particularly, to the associated stem 152, 162. The flex connection assembly 200 may, for example, be brazed or welded to the associated stem 152, 162. In another exemplary embodiment, a flex connection assembly 200 is structured to be, and is, removably coupled to the associated contact assembly 150, 160 and, more particularly, to the associated stem 152, 162. In this embodiment, the flex connection assembly 200 may, for example, be coupled to the associated stem 152, 162, by removable coupling such as, but not limited to, threaded coupling components (not shown). Such threaded coupling components are disposed at easy to access locations. For example, a removable coupling (not shown) structured to couple the movable coupling 204A and the first contact assembly stem 152 is disposed generally centrally on the lower side of the movable coupling 204A. Such a removable coupling is easily accessed through a central opening 216A (FIG. 5). Further, first flex connection assembly fixed coupling body 206A, in an exemplary embodiment, includes threaded passages or bores 218A. In this exemplary embodiment, load terminal 22 includes fastener access passages 28 (FIG. 2). It is understood that threaded coupling components (not shown) are passed through load terminal access passages 28 and are threaded into first flex connection assembly fixed coupling body bores 218A.

In an exemplary embodiment, a vacuum interrupter assembly 30 having one movable contact assembly 150 is assembled as follows. The first bellows assembly 100A is sealingly coupled to the first seal cup 44. In an exemplary embodiment, the first bellows assembly body first end 106 is welded to the first seal cup 44 at the seal cup planar portion 60 with the bellows assembly body passage 108 disposed about the seal cup central opening 61. The first bellows assembly 100A is not within the seal cup enclosed space 70. That is, the first bellows assembly 100A is sealingly coupled to the seal cup planar portion 60 on the side opposite the seal cup enclosed space 70.

The first contact assembly stem 152, and in an exemplary embodiment, the first contact assembly stem body first end 157 and medial portion 158 are passed through the bellows assembly body passage 108 and the seal cup central opening 61. The first contact assembly contact member 154 is not within the seal cup enclosed space 70. The first contact assembly stem body medial portion 158 or second end 159 includes a flange 151. The bellows assembly body second end 107 is sealingly coupled to the first contact assembly stem body medial portion 158 or second end 159 at a flange 151.

The bushing assembly 110 is disposed on the first contact assembly stem 152. That is, the first contact assembly stem 152 extends through the bushing assembly collar portion body central opening 118 and the bushing assembly sheath portion body passage 132. As noted above, the components of the anti-rotation assembly 134 are coupled, directly coupled, or fixed to each other and resist, or prevent, rotation of the bushing assembly 110 relative to the first contact assembly stem 152. The bushing assembly 110 is disposed at the first contact assembly stem body medial portion 158 and extends through the first seal cup planar portion 60. That is, the bushing assembly collar portion body 116 is disposed in the vacuum chamber enclosed space 50 with the bushing assembly sheath portion body 130 extending through the bushing assembly collar portion body central opening 118. Further, in an exemplary embodiment, the bushing assembly collar portion body 116 is coupled, directly coupled, or fixed to the seal cup planar portion 60 within the seal cup enclosed space 70.

The first seal cup flange 64, and in an exemplary embodiment the outer periphery of the first cup seal cup flange 64, is sealingly coupled to the vacuum chamber housing assembly sidewall first end 52. In an exemplary embodiment, the first seal cup flange 64 is welded to the vacuum chamber housing assembly sidewall first end 52. Further, the first seal cup 44 is disposed in an inverted orientation in the vacuum chamber housing assembly sidewall 42, as described above.

The fixed contact assembly 160 is coupled to the second seal cup 46 as follows. The second contact assembly stem body 166 is passed through the second seal cup body opening 49. The second contact assembly stem body 166 is sealingly coupled to the second seal cup body 47. In an exemplary embodiment, the second contact assembly stem body 166 is welded to the second seal cup body 47. The second seal cup 46 is sealingly coupled to the vacuum chamber housing assembly sidewall second end 56. In an exemplary embodiment, the second seal cup body 47 is welded to the vacuum chamber housing assembly sidewall second end 56.

In this configuration, the vacuum chamber enclosed space 50 is sealed and a vacuum may be created therein. That is, the vacuum chamber housing assembly sidewall second end 56 is sealingly coupled to the second seal cup 46 which is, in turn, sealingly coupled to the second contact assembly stem body 166. This configuration seals the vacuum chamber housing assembly sidewall second end 56. The first seal cup 44 is sealingly coupled to the vacuum chamber housing assembly sidewall first end 52. The bellows assembly 100 is sealingly coupled to the first seal cup 44 and the first contact assembly stem body medial portion 158 or second end 159. This configuration seals the vacuum chamber housing assembly sidewall first end 52. Thus, the vacuum chamber enclosed space 50 is sealed. It is understood that a vacuum assembly (not shown) allows a vacuum, or a near vacuum condition, to be created in the vacuum chamber enclosed space 50.

Further, in this configuration, the first bellows assembly 100A is configured as a "pressurized bellows." That is, when a movable contact assembly stem 152 passes through a bellows assembly 100, there is a defined space between the movable contact assembly stem 152 and the bellows assembly body 104; this defined space is also the bellows assembly body passage 108. Depending upon where the bellows assembly 100 is sealingly coupled to the movable contact assembly stem 152, the bellows assembly body passage 108 is either in fluid communication with the vacuum chamber enclosed space 50 or the atmosphere. That is, if the bellows assembly 100 is sealingly coupled to the movable contact assembly stem 152 adjacent the first contact assembly stem second end 159, the bellows assembly body passage 108 is generally in fluid communication with the atmosphere. As used herein, a bellows assembly body passage 108 that is generally in fluid communication with the atmosphere is a "pressurized bellows" in that the atmosphere pressurizes the bellows. Conversely, if the bellows assembly 100 is sealingly coupled to the movable contact assembly stem 152 adjacent the first contact assembly stem first end 157, the bellows assembly body passage 108 is generally in fluid communication with the vacuum chamber enclosed space 50. As used herein, a bellows assembly body passage 108 that is generally in fluid communication with the vacuum chamber enclosed space 50 is a "vacuum bellows" in that the bellows assembly body passage 108 is also subjected to the vacuum. It is noted that the pressurized bellows disclosed herein allow for the bellows assembly body passage 108 to be in fluid communication with the bushing assembly collar portion body fluid passages 124.

The vacuum chamber 34 is coupled, directly coupled, or fixed to the low voltage portion housing 16. As shown the vacuum chamber 34 is, in an exemplary embodiment, spaced, via stand-off supports 18, from the low voltage portion housing 16. The line terminal 20 and the load terminal 22 are also coupled, directly coupled, or fixed to the low voltage portion housing 16 at the stand-off supports 18. The line terminal 20 is coupled to, and in electrical communication with, the fixed contact assembly 160 via fixed coupling 21. That is, the line terminal 20 is coupled to, and in electrical communication with, the fixed, second contact assembly proximal first end 167 via fixed coupling 23 and flex connection assemblies 200.

The movable, first contact assembly 150A is coupled to the load terminal 22 and the operating mechanism 32 via the flex connection assembly 200. That is, the first flex connection assembly 200A is, in an exemplary embodiment, temporarily coupled to each of the first contact assembly 150A, the load terminal 22, and the operating mechanism 32. In another embodiment, the first flex connection assembly 200A is coupled, directly coupled, or fixed to each of the first contact assembly 150A, the load terminal 22, and the operating mechanism 32. In an exemplary embodiment, when installed, the first flex connection assembly 200A is disposed in the first seal cup enclosed space 70. It is noted this configuration aids in solving the problem of overly long moving contact assembly contact stems.

That is, in an exemplary embodiment, the first flex connection assembly 200A is disposed in the first seal cup enclosed space 70 with first flex connection assembly fixed coupling 202A temporarily coupled to, and in electrical communication with, the load terminal 22. The first flex connection assembly movable coupling 204A is temporarily coupled to, and in electrical communication with, the first contact assembly stem body proximal first end 157. Further, the actuator link member 38 extends through the first flex connection assembly fixed coupling conductive body 206A and operatively coupled to the first flex connection assembly movable coupling 204A. The actuator link member 38 is further operatively coupled to the operating mechanism 32.

In this configuration, the vacuum circuit breaker 10 operates as follows. For this example, it is assumed that the movable, first contact assembly 150A is in a second position wherein the first contact assembly 150A is directly coupled to, and in electrical communication with the fixed, second contact assembly 160. That is, within the vacuum chamber 34 the first contact assembly contact member 154 and the second contact assembly contact member 164 are directly coupled.

Upon receiving a signal from the control device, the operating mechanism 32 moves the movable, first contact assembly 150A to a first position wherein the first contact assembly 150A is directly coupled to, and in electrical communication with the fixed, second contact assembly 160. During this operation, the flex connection assembly 200 moves from the second configuration, wherein the first flex connection assembly movable coupling conductive body 208A is spaced from the first flex connection assembly fixed coupling body 206A, to the first configuration, wherein the first flex connection assembly movable coupling body 208A is disposed closer to the first flex connection assembly fixed coupling body 206A. During a closing operation, the motion of the elements discussed above is reversed. That is, the elements move from their first position/configuration to their second position/configuration.

Figure 7:
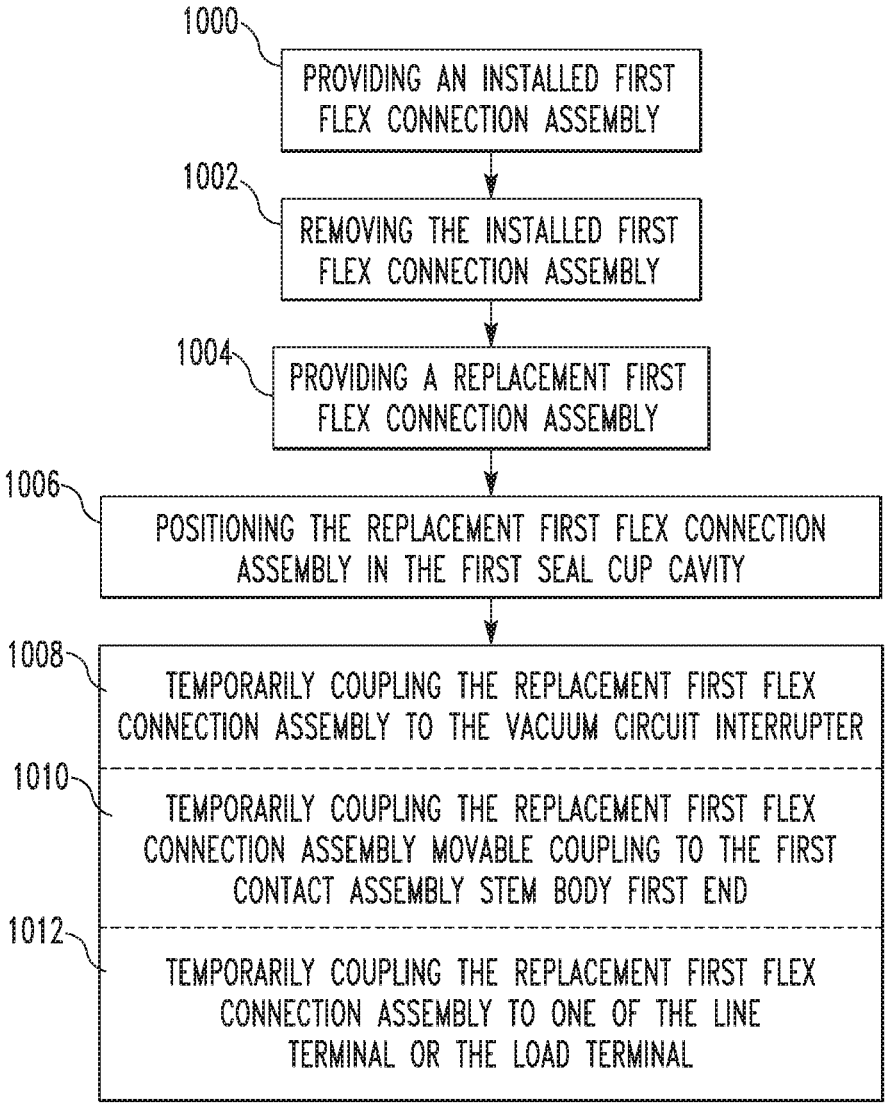
FIG. 7 is a flowchart of the disclosed method.

Moreover, the first flex connection assembly 200A may be swapped for another first flex connection assembly 200A thereby changing the operational characteristics of the vacuum chamber 34. That is, as shown in FIG. 7, a method of utilizing a vacuum circuit interrupter 10 as described above includes providing 1000 an "installed first flex connection assembly 200A'." As used herein, the "installed first flex connection assembly 200A'" means the first flex connection assembly 200A that is presently installed and coupled to the vacuum circuit interrupter 10 as described above. The installed first flex connection assembly 200A' has a first set of characteristics. Further, the installed first flex connection assembly includes a fixed coupling and a movable coupling, wherein the installed first flex connection assembly fixed coupling and the installed first flex connection assembly movable coupling are coupled to, and in electrical communication with, each other, the installed first flex connection assembly 200A disposed in the first seal cup cavity, wherein the installed first flex connection assembly movable coupling is temporarily coupled to, and in electrical communication with, the first contact assembly stem body first end 157. The method further includes removing 1002 the installed first flex connection assembly 200A', providing 1004 a "replacement first flex connection assembly 200A'." As used herein, the "replacement first flex connection assembly 200A" is the first flex connection assembly 200 which replaces the installed first flex connection assembly 200A'. The replacement first flex connection assembly 200A" has a second set of characteristics. The replacement first flex connection assembly 200A" includes a fixed coupling and a movable coupling, wherein the replacement first flex connection assembly fixed coupling and the replacement first flex connection assembly movable coupling are coupled to, and in electrical communication with, each other.

The method further includes positioning 1006 the replacement first flex connection assembly 200A" in the first seal cup cavity, temporarily coupling 1008 the replacement first flex connection assembly 200A" to the vacuum circuit interrupter. In this configuration, the replacement first flex connection assembly 200A" is in electrical communication with the first contact assembly stem body first end 167.

Further, temporarily coupling 1008 the replacement first flex connection assembly to the vacuum circuit interrupter 10 includes temporarily coupling 1010 the replacement first flex connection assembly movable coupling to the first contact assembly stem body first end 167, and, temporarily coupling 1012 the replacement first flex connection assembly fixed coupling to one of the line terminal 20 or the load terminal 22.

As noted above, and as shown in FIG. 8, the vacuum interrupter assembly 30 may also include two movable contact assemblies 150A, 150B. In this configuration, the second contact assembly 150B is coupled to the second seal cup 46 by a second bellows assembly 100B. Further, in this embodiment, the second seal cup 46 is configured in a manner similar to the first seal cup 44, i.e., with a sidewall 62 and flange 64. Further, in this embodiment, a second flex connection assembly 200B is disposed within the second seal cup 46 and is coupled to, and in electrical communication with both the line terminal 20 and the second contact assembly 150B. The specific details of the second contact assembly 150B will not be discussed in detail, but it is noted that the second contact assembly 150B, as well as the associated elements, such as but not limited to the second seal cup 46 and the second flex connection assembly 200B are substantially similar to the first movable contact assembly 150A discussed above. Further, in the figures, elements of the second contact assembly 150B share similar reference numbers but are identified by the letter "B."

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A vacuum interrupter assembly comprising:

an operating mechanism;

a vacuum chamber including a number of bellows assemblies;

a conductor assembly including a first contact assembly and a second contact assembly;

said first contact assembly including a stem and a contact member;

said first contact assembly stem including an elongated body with a proximal first end, a medial portion, and a distal second end;

said first contact assembly contact member coupled to, and in electrical communication with, said first contact assembly stem body second end;

said first contact assembly contact member disposed in said vacuum chamber;

said second contact assembly including a stem and a contact member;

said second contact assembly stem including an elongated body with a proximal first end, a medial portion, and a distal second end;

said second contact assembly contact member coupled to, and in electrical communication with, said second contact assembly stem body second end;

said second contact assembly contact member disposed in said vacuum chamber;

said operating mechanism operatively coupled to said first contact assembly stem body first end, wherein said first contact assembly contact member is structured to move between a first position, wherein said first contact assembly contact member is not directly coupled to said second contact assembly contact member, and a second position, wherein said first contact assembly contact member is coupled to, and in electrical communication with said second contact assembly contact member;

wherein said first contact assembly stem body has a reduced length;

said number of bellows assemblies includes a first bellows assembly;

wherein said first bellows assembly is a metal weld bellows;

wherein said first bellows assembly is configured as a pressurized bellows;

wherein said first bellows assembly includes an anti-twist bushing assembly;

said bushing assembly including a collar portion and a sheath portion;

said bushing assembly collar portion including a generally planar body defining a central opening, said bushing assembly collar portion body central opening generally corresponding to said first contact assembly stem body first end; and said bushing assembly sheath portion including a generally cylindrical body defining a central passage, said bushing assembly sheath portion body central passage generally corresponding to said first contact assembly stem body first end and said first contact assembly stem body medial portion.

2. The vacuum interrupter assembly of claim 1 wherein:

said first contact assembly stem body generally extends through said first bellows assembly defining an interior bellows space;

said bushing assembly collar portion body includes a first planar surface and an opposing second planar surface;

said bushing assembly collar portion body includes a number of fluid passages extending from said bushing assembly collar portion body first planar surface to said bushing assembly collar portion body second planar surface; and said bushing assembly collar portion body fluid passages are in fluid communication with said interior bellows space.

3. A vacuum interrupter assembly comprising:

an operating mechanism;

a vacuum chamber including a number of bellows assemblies;

a conductor assembly including a first contact assembly and a second contact assembly;

said first contact assembly including a stem and a contact member;

said first contact assembly stem including an elongated body with a proximal first end, a medial portion, and a distal second end;

said first contact assembly contact member coupled to, and in electrical communication with, said first contact assembly stem body second end;

said first contact assembly contact member disposed in said vacuum chamber;

said second contact assembly including a stem and a contact member;

said second contact assembly stem including an elongated body with a proximal first end, a medial portion, and a distal second end;

said second contact assembly contact member coupled to, and in electrical communication with, said second contact assembly stem body second end;

said second contact assembly contact member disposed in said vacuum chamber;

said operating mechanism operatively coupled to said first contact assembly stem body first end, wherein said first contact assembly contact member is structured to move between a first position, wherein said first contact assembly contact member is not directly coupled to said second contact assembly contact member, and a second position, wherein said first contact assembly contact member is coupled to, and in electrical communication with said second contact assembly contact member;

wherein said first contact assembly stem body has a reduced length;

said vacuum chamber includes a first seal cup;

said first seal cup disposed in an inverted orientation and defining a cavity in said vacuum chamber;

said conductor assembly including a first flex connection assembly, said first flex connection assembly including a fixed coupling and a movable coupling, wherein said first flex connection assembly fixed coupling and said first flex connection assembly movable coupling are coupled to, and in electrical communication with, each other;

said first flex connection assembly disposed in said first seal cup cavity; and wherein said first flex connection assembly movable coupling is temporarily coupled to, and in electrical communication with, said first contact assembly stem body first end.

4. The vacuum interrupter assembly of claim 3 wherein:

said first flex connection assembly includes a number of flexible conductors:

each said first flex connection assembly flexible conductor including a first end and a second end;

each said first flex connection assembly flexible conductor first end coupled to, and in electrical communication with, said first flex connection assembly fixed coupling;

each said first flex connection assembly flexible conductor second end coupled to, and in electrical communication with, said first flex connection assembly movable coupling;

said first contact assembly stem body first end including a center; and said number of first flex connection assembly flexible conductors disposed about said first contact assembly stem body first end center.

5. The vacuum interrupter assembly of claim 4 wherein:

said operating mechanism includes an elongated actuator link member;

said actuator link member temporarily coupled to said first flex connection assembly movable coupling;

said actuator link member including a body; and wherein said actuator link member body has a reduced mass.

6. The vacuum interrupter assembly of claim 3 wherein:

said vacuum chamber includes a second seal cup;

said second seal cup disposed in an inverted orientation and defining a cavity in said vacuum chamber;

said conductor assembly including a second flex connection assembly, said second flex connection assembly including a fixed coupling and a movable coupling, wherein said second flex connection assembly fixed coupling and said second flex connection assembly movable coupling are coupled to, and in electrical communication with, each other;

said second flex connection assembly disposed in said second seal cup cavity; and wherein said second flex connection assembly movable coupling is temporarily coupled to, and in electrical communication with, said second contact assembly stem body first end.

7. A vacuum circuit interrupter comprising:

a low voltage portion, and high voltage portion;

said low voltage portion operatively coupled to said high voltage portion;

said high voltage portion including a line terminal, a load terminal, and a vacuum interrupter assembly;

said load terminal including a fixed coupling;

said line terminal including a fixed coupling;

said vacuum interrupter assembly including an operating mechanism, a vacuum chamber and a conductor assembly;

said vacuum chamber including a number of bellows assemblies;

said conductor assembly including a first contact assembly and a second contact assembly;

said first contact assembly including a stem and a contact member;

said first contact assembly stem including an elongated body with a proximal first end, a medial portion, and a distal second end;

said first contact assembly contact member coupled to, and in electrical communication with, said first contact assembly stem body second end;

said first contact assembly contact member disposed in said vacuum chamber;

said second contact assembly including a stem and a contact member;

said second contact assembly stem including an elongated body with a proximal first end, a medial portion, and a distal second end;

said second contact assembly contact member coupled to, and in electrical communication with, said second contact assembly stem body second end;

said second contact assembly contact member disposed in said vacuum chamber;

said first contact assembly stem first end coupled to, and in electrical communication with, one of said load terminal fixed coupling or said line terminal fixed coupling;

said second contact assembly stem first end coupled to, and in electrical communication with, the other of said load terminal fixed coupling or said line terminal fixed coupling;

said operating mechanism operatively coupled to said first contact assembly stem body first end, wherein said first contact assembly contact member is structured to move between a first position, wherein said first contact assembly contact member is not directly coupled to said second contact assembly contact member, and a second position, wherein said first contact assembly contact member is coupled to, and in electrical communication with, said second contact assembly contact member;

wherein said first contact assembly stem body has a reduced length;

said number of bellows assemblies includes a first bellows assembly;

wherein said first bellows assembly is a metal weld bellows;

wherein said first bellows assembly is configured as a pressurized bellows;

wherein said first bellows assembly includes an anti-twist bushing assembly;

said bushing assembly including a collar portion and a sheath portion;

said bushing assembly collar portion including a generally planar body defining a central opening, said bushing assembly collar portion body central opening generally corresponding to said first contact assembly stem body first end; and said bushing assembly sheath portion including a generally cylindrical body defining a central passage, said bushing assembly sheath portion body central passage generally corresponding to said first contact assembly stem body first end and said first contact assembly stem body medial portion.

8. The vacuum circuit interrupter of claim 7 wherein:

said first contact assembly stem body generally extends through said first bellows assembly defining an interior bellows space;

said bushing assembly collar portion body includes a first planar surface and an opposing second planar surface;

said bushing assembly collar portion body includes a number of fluid passages extending from said bushing assembly collar portion body first planar surface to said bushing assembly collar portion body second planar surface; and said bushing assembly collar portion body fluid passages are in fluid communication with said interior bellows space.

9. A vacuum circuit interrupter comprising:

a low voltage portion, and high voltage portion;

said low voltage portion operatively coupled to said high voltage portion;

said high voltage portion including a line terminal, a load terminal, and a vacuum interrupter assembly;

said load terminal including a fixed coupling;

said line terminal including a fixed coupling;

said vacuum interrupter assembly including an operating mechanism, a vacuum chamber and a conductor assembly;

said vacuum chamber including a number of bellows assemblies;

said conductor assembly including a first contact assembly and a second contact assembly;

said first contact assembly including a stem and a contact member;

said first contact assembly stem including an elongated body with a proximal first end, a medial portion, and a distal second end;

said first contact assembly contact member coupled to, and in electrical communication with, said first contact assembly stem body second end;

said first contact assembly contact member disposed in said vacuum chamber;

said second contact assembly including a stem and a contact member;

said second contact assembly stem including an elongated body with a proximal first end, a medial portion, and a distal second end;

said second contact assembly contact member coupled to, and in electrical communication with, said second contact assembly stem body second end;

said second contact assembly contact member disposed in said vacuum chamber;

said first contact assembly stem first end coupled to, and in electrical communication with, one of said load terminal fixed coupling or said line terminal fixed coupling;

said second contact assembly stem first end coupled to, and in electrical communication with, the other of said load terminal fixed coupling or said line terminal fixed coupling;

said operating mechanism operatively coupled to said first contact assembly stem body first end, wherein said first contact assembly contact member is structured to move between a first position, wherein said first contact assembly contact member is not directly coupled to said second contact assembly contact member, and a second position, wherein said first contact assembly contact member is coupled to, and in electrical communication with, said second contact assembly contact member;

wherein said first contact assembly stem body has a reduced length;

said vacuum chamber includes a first seal cup;

said first seal cup disposed in an inverted orientation and defining a cavity in said vacuum chamber;

said conductor assembly including a first flex connection assembly, said first flex connection assembly including a fixed coupling and a movable coupling, wherein said first flex connection assembly fixed coupling and said first flex connection assembly movable coupling are coupled to, and in electrical communication with, each other;

said first flex connection assembly disposed in said first seal cup cavity; and wherein said first flex connection assembly movable coupling is temporarily coupled to, and in electrical communication with, said first contact assembly stem body first end.

10. The vacuum circuit interrupter of claim 9 wherein:

said first flex connection assembly includes a number of flexible conductors:

each said first flex connection assembly flexible conductor including a first end and a second end;

each said first flex connection assembly flexible conductor first end coupled to, and in electrical communication with, said first flex connection assembly fixed coupling;

each said first flex connection assembly flexible conductor second end coupled to, and in electrical communication with, said first flex connection assembly movable coupling;

said first contact assembly stem body first end including a center; and said number of first flex connection assembly flexible conductors disposed about said first contact assembly stem body first end center.

11. The vacuum circuit interrupter of claim 10 wherein:

said operating mechanism includes an actuator link member;

said actuator link member temporarily coupled to said first flex connection assembly movable coupling;

said actuator link member including a body; and wherein said actuator link member body has a reduced mass.

12. The vacuum circuit interrupter of claim 11 wherein:

said vacuum chamber includes a second seal cup;

said second seal cup disposed in an inverted orientation and defining a cavity in said vacuum chamber;

said conductor assembly including a second flex connection assembly, said second flex connection assembly including a fixed coupling and a movable coupling, wherein said second flex connection assembly fixed coupling and said second flex connection assembly movable coupling are coupled to, and in electrical communication with, each other;

said second flex connection assembly disposed in said second seal cup cavity; and wherein said second flex connection assembly movable coupling is temporarily coupled to, and in electrical communication with, said second contact assembly stem body first end.

13. A method of utilizing a vacuum circuit interrupter, said vacuum circuit interrupter including a low voltage portion, and high voltage portion, said low voltage portion operatively coupled to said high voltage portion, said high voltage portion including a line terminal, a load terminal, and a vacuum interrupter assembly, said load terminal including a fixed coupling, said line terminal including a fixed coupling, said vacuum interrupter assembly including an operating mechanism, a vacuum chamber and a conductor assembly, said vacuum chamber including a number of bellows assemblies, said conductor assembly including a first contact assembly and a second contact assembly, said first contact assembly including a stem and a contact member, said first contact assembly stem including an elongated body with a proximal first end, a medial portion, and a distal second end, said first contact assembly contact member coupled to, and in electrical communication with, said first contact assembly stem body second end, said first contact assembly contact member disposed in said vacuum chamber, said second contact assembly including a stem and a contact member, said second contact assembly stem including an elongated body with a proximal first end, a medial portion, and a distal second end, said second contact assembly contact member coupled to, and in electrical communication with, said second contact assembly stem body second end, said second contact assembly contact member disposed in said vacuum chamber, said first contact assembly stem first end coupled to, and in electrical communication with, one of said load terminal fixed coupling or said line terminal fixed coupling, said second contact assembly stem first end coupled to, and in electrical communication with, the other of said load terminal fixed coupling or said line terminal fixed coupling, said operating mechanism operatively coupled to said first contact assembly stem body first end, wherein said first contact assembly contact member is structured to move between a first position, wherein said first contact assembly contact member is not directly coupled to said second contact assembly contact member, and a second position, wherein said first contact assembly contact member is coupled to, and in electrical communication with, said second contact assembly contact member, said vacuum chamber includes a first seal cup, said first seal cup disposed in an inverted orientation and defining a cavity in said vacuum chamber, said method comprising:

providing an installed first flex connection assembly having a first set of characteristics, said installed first flex connection assembly including a fixed coupling and a movable coupling, wherein said installed first flex connection assembly fixed coupling and said installed first flex connection assembly movable coupling are coupled to, and in electrical communication with, each other, said installed first flex connection assembly disposed in said first seal cup cavity, wherein said installed first flex connection assembly movable coupling is temporarily coupled to, and in electrical communication with, said first contact assembly stem body first end;

removing said installed first flex connection assembly;

providing a replacement first flex connection assembly having a second set of characteristics, said replacement first flex connection assembly including a fixed coupling and a movable coupling, wherein said replacement first flex connection assembly fixed coupling and said replacement first flex connection assembly movable coupling are coupled to, and in electrical communication with, each other;

positioning said replacement first flex connection assembly in said first seal cup cavity;

temporarily coupling said replacement first flex connection assembly to said vacuum circuit interrupter; and wherein said replacement first flex connection assembly is in electrical communication with said first contact assembly stem body first end.

14. The method of claim 13 wherein temporarily coupling said replacement first flex connection assembly to said vacuum circuit interrupter includes:

temporarily coupling said replacement first flex connection assembly movable coupling to said first contact assembly stem body first end; and temporarily coupling said replacement first flex connection assembly fixed coupling to one of said line terminal or said load terminal.

* * * * *